US010222741B2

(12) United States Patent
Burdon et al.

(10) Patent No.: US 10,222,741 B2
(45) Date of Patent: Mar. 5, 2019

(54) DRIVE SHAFT ELECTRICAL CONTACT FOR PRINT CARTRIDGE PHOTORECEPTOR GROUNDING

(71) Applicant: Xerox Corporation, Norwalk, CT (US)

(72) Inventors: Ian Burdon, Hertfordshire (GB); Joseph R. Broughton, Hertfordshire (GB); John R. Washington, Hertfordshire (GB); Peter J. Cresswell, Hertfordshire (GB)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/665,982

(22) Filed: Aug. 1, 2017

(65) Prior Publication Data

US 2019/0041793 A1 Feb. 7, 2019

(51) Int. Cl.
*G03G 21/18* (2006.01)

(52) U.S. Cl.
CPC ..... *G03G 21/1867* (2013.01)

(58) Field of Classification Search
CPC ..... G03G 21/1871; G03G 21/1867
See application file for complete search history.

(56) References Cited

U.S. PATENT DOCUMENTS 5,537,189 A 7/1996 Imes
5,630,196 A 5/1997 Swain
5,655,182 A 8/1997 Sanchez et al.
5,752,136 A 5/1998 Sanchez et al.
5,778,283 A 7/1998 Damji et al.
5,815,773 A 9/1998 Zaman
5,845,175 A 12/1998 Kumar et al.
5,937,241 A 8/1999 Kumar et al.
6,167,219 A 12/2000 Miyamoto et al.
6,289,188 B1 9/2001 Litman et al.
6,381,429 B1 4/2002 Shibata et al.
6,382,837 B1 5/2002 Olbrich et al.
6,490,426 B1 12/2002 Zaman
6,771,927 B2 8/2004 Bloemen et al.
6,788,909 B2 9/2004 Prichett
6,907,205 B2 6/2005 Himes et al.
7,103,297 B2 9/2006 Guy et al.
7,292,804 B2 11/2007 Preston et al.
7,346,292 B2 3/2008 Williams et al.
7,529,509 B2 5/2009 Ito et al.
7,537,410 B2 5/2009 Parisi et al.
7,587,160 B2 9/2009 Thomas et al.
7,664,426 B2 2/2010 Nishimura et al.
RE42,125 E 2/2011 Damji et al.
7,977,022 B2 7/2011 Takeda et al.
8,682,199 B2 3/2014 Toyoda et al.
8,712,277 B2 4/2014 Ooyoshi
(Continued)

FOREIGN PATENT DOCUMENTS

JP 2001100438 A * 4/2001

*Primary Examiner* — Sevan A Aydin
(74) *Attorney, Agent, or Firm* — Fay Sharpe LLP

(57) ABSTRACT

Disclosed is a xerographic printing apparatus and print cartridge including a deformable electrically conductive ring. According to an exemplary embodiment, a xerographic image rendering print cartridge includes a drive shaft, a photoreceptor drum and a deformable electrically conductive ring operatively associated with electrically connecting an inside surface of the photoreceptor drum to the drive shaft to provide a grounding electrical path.

18 Claims, 7 Drawing Sheets

(56) References Cited

U.S. PATENT DOCUMENTS

| | | | | |
|---|---|---|---|---|
| 8,784,946 | B2 | 7/2014 | Fowler et al. | |
| 8,849,165 | B2 | 9/2014 | Tamarez Gomez et al. | |
| 8,929,768 | B2 | 1/2015 | Zona et al. | |
| 9,058,007 | B2 | 6/2015 | Iijima et al. | |
| 9,236,677 | B2 | 1/2016 | Cole et al. | |
| 9,477,174 | B1 | 10/2016 | Hill et al. | |
| 2001/0001057 | A1* | 5/2001 | Melnyk | G03G 5/047 430/57.3 |
| 2003/0223773 | A1 | 12/2003 | Prichett | |
| 2003/0223774 | A1 | 12/2003 | Himes et al. | |
| 2006/0159485 | A1 | 7/2006 | Nishimura et al. | |
| 2007/0025759 | A1 | 2/2007 | William et al. | |
| 2008/0187368 | A1* | 8/2008 | Watanabe | G03G 15/751 399/286 |
| 2016/0139518 | A1 | 5/2016 | Prizant et al. | |

* cited by examiner

DRIVE SHAFT ELECTRICAL CONTACT FOR PRINT CARTRIDGE PHOTORECEPTOR GROUNDING

BACKGROUND

This disclosure relates to xerographic or electrostatographic printing machines, and more particularly to a robust apparatus and method of grounding an electrically conductive drum photoreceptor assembly in such a printing machine. The phrase printing machine includes both printing and copying devices.

As is well known, the electrically conductive photoreceptor in an electrophotographic or xerographic printing machine requires grounding for proper operation. One conventional grounding apparatus and method employs a metal strip mechanically attached to one of the non-metallic flanges that cap the ends of the electrically conductive photoreceptor. One end of the metal strip contacts the inside of the electrically conductive photoreceptor while the other end of the metal strip contacts the center metal shaft which rotates the photoreceptor, thus completing the grounding circuit. Any deformation of the metal strip during assembly, however, can result in loss of ground, either permanently or intermittently. Repair of the metal strip within the photoreceptor is difficult since the end flanges are glued in.

Examples of prior efforts at grounding the conductive photoreceptor include U.S. Pat. No. 5,537,189 entitled "Printing apparatus which grounds photoreceptor independently of CRU" that discloses an electrostatographic printing apparatus having (a) a detachable imaging module including a housing and a photosensitive member, wherein the photosensitive member is partially enclosed within the housing, and wherein the photosensitive member has an outer surface which includes an electrically conductive portion; (b) an electrically grounded component free of attachment to the module; and (c) an electrically conductive part, free of attachment to the module, in contact with both the grounded component and the conductive portion on the outer surface of the photosensitive member, thereby establishing grounding of the photosensitive member, and wherein upon removal of the imaging module the part remains in contact with the grounded component and upon insertion of a new detachable imaging module which has a new photosensitive member having an outer surface that includes an electrically conductive portion, the part contacts the electrically conductive portion on the outer surface of the new photosensitive member, thereby establishing grounding of the new photosensitive member.

U.S. Pat. No. 5,815,773 entitled "Composite photoreceptor flange" discloses an end flange capable of translating a rotational force from an outside source to a hollow cylindrical member is disclosed. The end flange is made from a composition which includes polycarbonate, polytetrafluorethylene, and glass. The end flange may be used to rotate an electrophotographic imaging member past a charging station, for generation of a uniform electrical potential thereon, and subsequent selective discharging of the imaging member and development of an electrostatic latent image. Most notably, mounting of the end flange to the imaging member does not require the use of an adhesive material. This enables successful recycling of the imaging member, and results in significant cost savings.

U.S. Pat. No. 5,752,136 entitled "Imaging member end flange and end flange assembly" discloses a hollow cylindrical electrostatographic imaging member supporting end flange including a disk shaped member, a supporting hub extending axially from the disk shaped member and a metal disk coaxially secured to the hub, the disk comprising a plurality of rectangular tabs extending radially from the disk in a direction away from an imaginary axis of the hub for engagement with the hollow cylindrical electrostatographic imaging member upon insertion of the hub and disk shaped member into one end of the hollow cylindrical electrostatographic imaging member. When this end flange is inserted into one end of the hollow cylindrical electrostatographic imaging member, the plurality of rectangular tabs extending radially from the disk engage the inner surface of the hollow cylindrical electrostatographic imaging member.

U.S. Pat. No. 7,103,297, entitled "Robust Apparatus and Method of Grounding a Drum Photoreceptor Assembly" discloses a photoreceptor grounding apparatus including (a) a flange including a first portion having a first diameter and a second portion having a second and smaller diameter; (b) a conductive plating formed on said flange presenting a relatively large conductive surface area for contactably assembling against walls of the conductive photoreceptor drum; and (c) an electrical connector for electrically connecting the large conductive surface area of the conductive plating to an electrically conductive drive shaft of the xerographic image producing machine.

Unfortunately, it has been found that electrical connections using such tabs or clips is not always properly made due to corrosion of or damage to the tabs or clips which are, of a necessity, made from a lightweight strip of very flexible and hence easily damaged strip of metal. These tabs or clips in addition only present a relatively small surface area to work with, and damage to them often includes bending. They may also be installed improperly and foreign material such as glue used to secure the drum to the flange may also interfere with this connection.

INCORPORATION BY REFERENCE

U.S. Pat. No. RE42,125 E, issued Feb. 8, 2011, by Damji et al. and entitled "DEVELOPMENT BIAS CONNECTOR WITH INTEGRAL BEARING SUPPORT";

U.S. Publication No. 2016/0139518, published May 19, 2016, by Prizant et al. and entitled "METHOD TO SIMULTANEOUSLY PROTECT A XEROGRAPHIC PHOTORECEPTOR FROM LIGHT SHOCK AND PROVIDE STARTUP LUBRICATION AT INSTALL";

U.S. Pat. No. 9,477,174, issued Oct. 25, 2016, by Hill et al. and entitled "USING ACCUMULATED PIXEL COUNTING TO ASSESS SOLID AREA DENSITY PERFORMANCE TO ENABLE AUTOMATIC DENSITY CORRECTION AND IMPROVE TONER YIELD";

U.S. Pat. No. 9,236,677, issued Jan. 12, 2016, by Cole et al. and entitled "SPRING POWER CONSTANT HAVING NON-LINEAR SLOT";

U.S. Pat. No. 8,929,768, issued Jan. 6, 2015, by Zona et al. and entitled "METHOD OF REMANUFACTURING A TONER CARTRIDGE AND REMANUFACTURED TONER CARTRIDGE";

U.S. Pat. No. 8,849,165, issued Sep. 30, 2014, by Tamarez Gomez et al. and entitled "WIRE-WRAPPED GROOVED ROLLERS FOR CLEANING ACTION USING BRUSH-LIKE SYSTEM";

U.S. Pat. No. 8,784,946, issued Jul. 22, 2014, by Fowler et al. and entitled "CONTINUOUS MANUFACTURING PROCESS FOR COATED-CORE CLEANER BLADES;

U.S. Pat. No. 7,587,160, issued Sep. 8, 2009, by Thomas et al. and entitled "TONER REPELLING STRIPPER FINGER ASSEMBLY";

U.S. Pat. No. 7,537,410, issued May 26, 2009, by Parisi et al. and entitled "COUPLING APPARATUS";

U.S. Pat. No. 7,292,804, issued Nov. 6, 2007, by Preston et al. and entitled "METHODS AND SYSTEMS FOR MOUNTING AN IMAGING MEDIA CARTRIDGE TO A PRINTER";

U.S. Pat. No. 7,103,297, issued Sep. 5, 2006, by Guy et al. and entitled "ROBUST APPARATUS AND METHOD OF GROUNDING A DRUM PHOTORECEPTOR ASSEMBLY";

U.S. Pat. No. 6,771,927, issued Aug. 3, 2004 by Bloemen et al. and entitled "TONER UNIT DRIVE ELEMENT FOR IMPROVED INSERTION";

U.S. Pat. No. 6,490,426, issued Dec. 3, 2002, by Zaman and entitled "MODULAR IMAGING MEMBER FLANGE ASSEMBLY";

U.S. Pat. No. 6,289,188, issued Sep. 11, 2001, by Litman et al. and entitled "NON-LEAKING AND EASILY REMANUFACTURED TONER CARTRIDGE";

U.S. Pat. No. 5,937,241, issued Aug. 10, 1999, by Kumar et al. and entitled "POSITIVE GEAR MOUNT FOR MOTION QUALITY";

U.S. Pat. No. 5,845,175, issued Dec. 1, 1998, by Kumar et al. and entitled "RIGID INTERFERENCE GEAR MOUNT FOR ENHANCED MOTION QUALITY";

U.S. Pat. No. 5,815,773, issued Sep. 29, 1998, by Zaman and entitled "COMPOSITE PHOTORECEPTOR FLANGE";

U.S. Pat. No. 5,778,283, issued Jul. 7, 1998, by Damji et al. and entitled "PROCESS CARTRIDGE INCLUDING A BANDING DEFECT PREVENTING WASTE TONER MOVING AUGER";

U.S. Pat. No. 5,752,136, issued May 12, 1998, by Sanchez et al. and entitled "IMAGING MEMBER END FLANGE AND END FLANGE ASSEMBLY";

U.S. Pat. No. 5,655,182, issued Aug. 5, 1997, by Sanchez et al. and entitled "METHOD AND APPARATUS FOR REUSING A PHOTORECEPTOR AND GEAR ASSEMBLY";

U.S. Pat. No. 5,630,196, issued May 13, 1997, by Swain and entitled "RECYCLABLE PHOTORECEPTOR END FLANGE";

U.S. Pat. No. 5,537,189, issued Jul. 16, 1996, by Imes and entitled "PRINTING APPARATUS WHICH GROUNDS PHOTORECEPTOR INDEPENDENTLY OF CRU", are incorporated herein by reference in their entirety.

BRIEF DESCRIPTION

In one embodiment of this disclosure, described is a xerographic image rendering print cartridge comprising: a drive shaft adapted to rotate at a rotational speed, the drive shaft including an electrically conductive outside surface associated with an outside diameter of the drive shaft; a photoreceptor drum including an outside charge retentive surface and an electrically conductive inside surface proximately located at a first longitudinal end of the photoreceptor drum, the electrically conductive inside surface operatively associated with an inside diameter of the photoreceptor drum; and a deformable electrically conductive ring operatively associated with electrically connecting the photoreceptor electrically conductive inside surface to the drive shaft electrically conductive outside surface, the deformable electrically conductive ring including an electrically conductive outside surface associated with an outside diameter of the deformable electrically conductive ring and an electrically conductive inside surface associated with an inside diameter of the deformable electrically conductive ring, the outside diameter of the deformable electrically conductive ring greater than or equal to the inside diameter of the photoreceptor drum inside diameter and the inside diameter of the deformable electrically conductive ring less than or equal to the outside diameter of the drive shaft.

In another embodiment of this disclosure, described is a xerographic image rendering print cartridge associated with a customer replaceable unit (CRU) comprising: a drive shaft adapted to rotate at a rotational speed, the drive shaft including an electrically conductive outside surface associated with an outside diameter of the drive shaft; a photoreceptor drum including an outside charge retentive surface and an electrically conductive inside surface proximately located at a first longitudinal end of the photoreceptor drum, the electrically conductive inside surface operatively associated with an inside diameter of the photoreceptor drum; and a deformable electrically conductive ring operatively associated with electrically connecting the photoreceptor electrically conductive inside surface to the drive shaft electrically conductive outside surface, the deformable electrically conductive ring including an electrically conductive outside surface associated with an outside diameter of the deformable electrically conductive ring and an electrically conductive inside surface associated with an inside diameter of the deformable electrically conductive ring, the outside diameter of the deformable electrically conductive ring greater than or equal to the inside diameter of the photoreceptor drum inside diameter and the inside diameter of the deformable electrically conductive ring less than or equal to the outside diameter of the drive shaft.

In still another embodiment of this disclosure, described is a xerographic printing apparatus comprising: a drive shaft adapted to rotate at a rotational speed, the drive shaft including an electrically conductive outside surface associated with an outside diameter of the drive shaft; a photoreceptor drum including an outside charge retentive surface and an electrically conductive inside surface proximately located at a first longitudinal end of the photoreceptor drum, the electrically conductive inside surface operatively associated with an inside diameter of the photoreceptor drum; a deformable electrically conductive ring operatively associated with electrically connecting the photoreceptor electrically conductive inside surface to the drive shaft electrically conductive outside surface, the deformable electrically conductive ring including an electrically conductive outside surface associated with an outside diameter of the deformable electrically conductive ring and an electrically conductive inside surface associated with an inside diameter of the deformable electrically conductive ring, the outside diameter of the deformable electrically conductive ring greater than or equal to the inside diameter of the photoreceptor drum inside diameter and the inside diameter of the deformable electrically conductive ring less than or equal to the outside diameter of the drive shaft; and a high voltage control circuit operatively connected to the photoreceptor outside charge retentive surface and operatively grounded to the electrically conductive outside surface.

DETAILED DESCRIPTION

Figure 1:
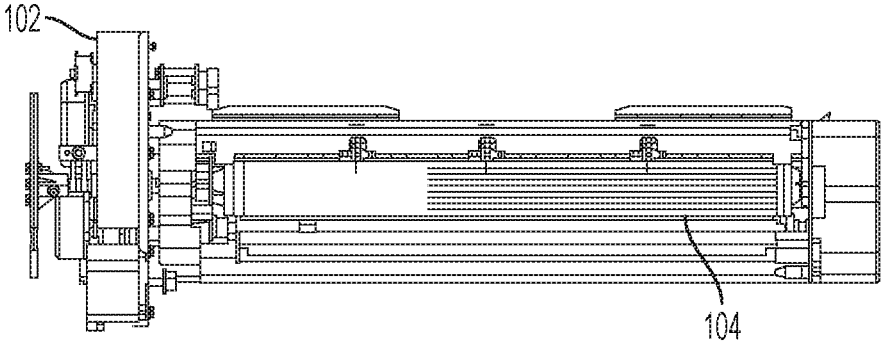
FIG. 1 is a side view of a xerographic image rendering print cartridge according to an exemplary embodiment of this disclosure.

This disclosure provides a multi-point shaft electrical contact for photoreceptor grounding. An annular conductive foam ring that contacts the photoreceptor inside diameter and a drive shaft outside diameter at thousands of contact points, according to an exemplary embodiment, as compared to a conventional two point contact. As discussed in the Background, conventional photoreceptor grounding systems eventually degrade enough to cause significant contact resistance leading to arcing which causes print defects and machine software crashes. As compared to a two contact point system, not all of the conductive foam contact points will lose continuity simultaneously, thus arcing should not occur. Benefits of the disclosed exemplary embodiments include the commercially availability of conductive foam for electromagnetic interference (EMI) control, as well as the shaft and the photoreceptor drum rotating together, so there is no relative motion. Conductive foam as a ground path is not novel, however, in this application the electrical connection between the drum and the shaft is part of the control system since the current is measured as an input to the control of the high voltage power supply.

When selecting high voltage contacts for a photoreceptor drum system, the contacts are required to be a very conductive material to get a low impedance connection that will not corrode or ark erode. Corrosion and erosion occurs when two standard conductive metals are mated against each other with a high voltage current going through them. This causes oxidation and therefore increases the resistance between the contacts until it becomes in-effective. Common materials often used to reduce corrosion are gold, silver, graphite and platinum. The problem with these materials is that they cost a lot of money and the materials do not have the mechanical properties for use as spring contacts.

This disclosure and the exemplary embodiments described herein use a conductive foam sheet attached to the inside of a print cartridge which mates with the drive shaft, also providing a ground contact, in order to maintain a high quality low impedance electrical connection between the photoreceptor and earth shaft. The use of a deformable conductive ring prevents spark erosion and can be implemented in the field by customers simply by replacing a "sparking" print cartridge with a customer replaceable unit (CRU) including a deformable conductive ring as described herein. The new cartridge acts as a clean contact.

Some existing photoreceptor-drives shaft ground connection are made up of contacts of mild steel. The two metals of similar conductivity allow for galvanic corrosion and arc erosion. Both of which result in poor electrical contact.

The result of this problem is that there is poor contact and therefore the photoreceptor cannot charge fully producing digital lines on copies, light copies and also the electrical current can sometimes arc onto the shaft which can cause the machine to reboot.

Because of the complexity of the photoreceptor drives shaft connection, a more conductive material cannot simple be used on the drive shaft as it will not have the required mechanical properties and it will be very costly.

The disclosed printing apparatus and cartridge use deformable conductive foam or rubber (possibly silver or graphite filled) attached to the inside diameter of the photoreceptor drum which mechanically joins to the drives shaft, thereby stopping corrosion and erosion by lowering the voltage field strength below arcing level.

Figure 2:
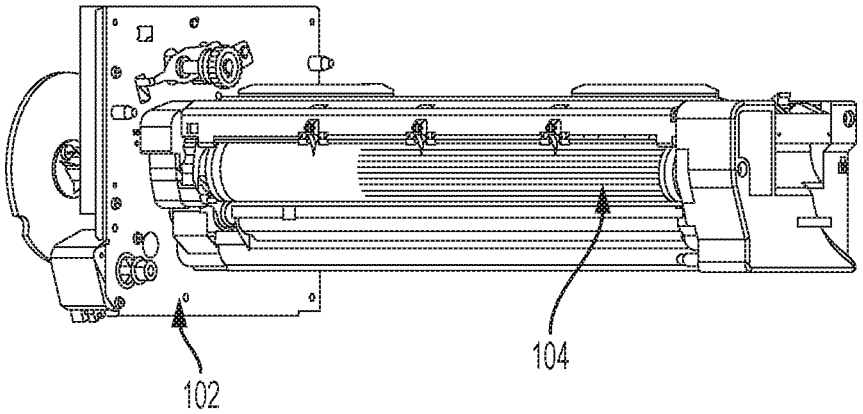
FIG. 2 is a perspective view of the xerographic image rendering print cartridge shown in FIG. 1.

FIG. 1 is a side view of a xerographic image rendering print cartridge according to an exemplary embodiment of this disclosure, and FIG. 2 is a perspective view of the xerographic image rendering print cartridge shown in FIG.

As shown in FIGS. 1 and 2, the print cartridge includes a drive unit 102 and a photoreceptor drum 104. In operation, the drive unit 102 engages the photoreceptor drum 104 to rotate as an electrostatic image is generated on the charge retentive surface of the drum 104.

Figure 3:
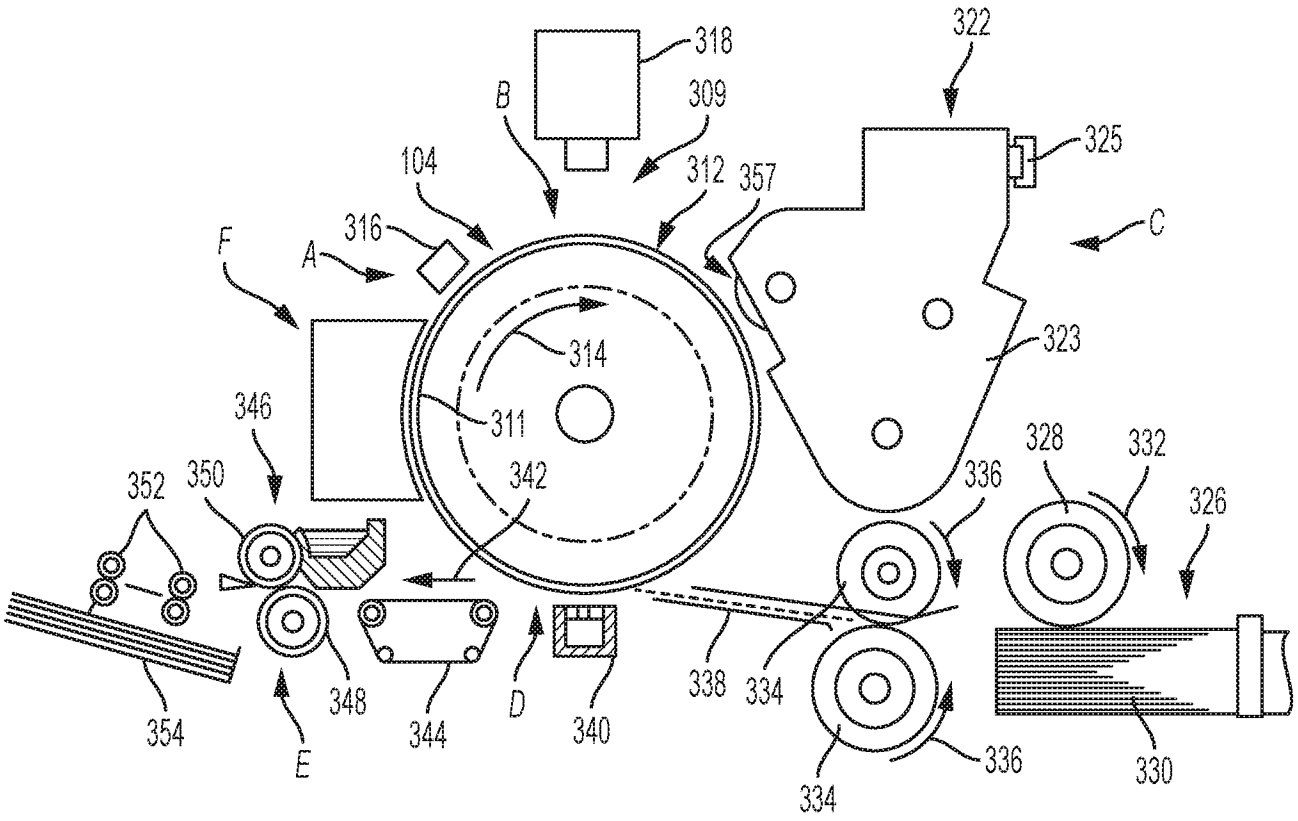
FIG. 3 is a schematic view of a xerographic printing apparatus including a photoreceptor drum and operatively associated deformable electrically conductive ring according to an exemplary embodiment of this disclosure.

FIG. 3 illustrates an exemplary electrostatographic reproduction machine that employs a photoreceptor assembly 309 including a drum 104 having a conductive substrate conductive or wall 311 and a photoconductive image carrying surface 312. Preferably, photoconductive surface 312 comprises a selenium alloy or organic photoreceptor (OPC) with the conductive substrate being an electrically grounded aluminum alloy. Drum 104 moves in the direction of arrow 314 to advance successive portions of photoconductive surface 312 sequentially through the various processing stations disposed about the path of movement thereof.

Initially, a portion of photoconductive surface 312 passes through charging station A. At charging station A, a corona generating device, indicated generally by the reference numeral 316, charges photoconductive surface 312 to a relatively high, substantially uniform potential.

Next, the charged portion of photoconductive surface 312 is advanced through imaging station B. Imaging station B includes an exposure system, indicated generally by the reference numeral 318. Exposure system 318 includes lamps that illuminate an original document positioned face down upon a transparent platen. The light rays reflected from the original document are transmitted through a lens to form a light image thereof. The light image is focused onto the charged portion of photoconductive surface 312 to selectively dissipate the charge thereon. This records an electrostatic latent image on photoconductive surface 312 that corresponds to the information in the original document.

Alternatively, exposure system 318 may be a laser-beam raster output scanner (ROS), such as used in a Laser Printer or Digital Copier. As is well known, in such a device a finely focused laser beam is made to scan repeatedly along the length of the charged portion of drum 104 while it advances beneath the beam. The light intensity of the laser beam is electronically modulated in order to selectively dissipate the charge on drum 104 thus creating an electrostatic latent image on photoconductive surface 312 which corresponds to the information required to be printed.

As a further alternative, exposure system 318 may be an array of light emitting diodes (LEDs) that illuminate the charged portion of drum 104 while it advances beneath the LED array. The light intensity of the LEDs is electronically modulated in order to selectively dissipate the charge on drum 104 thus creating an electrostatic latent image on photoconductive surface 312 which corresponds to the information required to be printed. Thereafter, drum 104 advances the electrostatic latent image recorded on photoconductive surface 312 to development station C.

At development station C, a developer unit 322 includes a hopper 323 with a capped refill opening 325. The development unit 322 also has a magnetic roll assembly 357, which transports a developer mixture of carrier granules having toner particles adhering triboelectrically thereto into contact with the electrostatic latent image. Toner particles are attracted from the carrier granules to the latent image forming a toner powder image.

Alternatively the developer material may be of the single component type. As is well known, such a developer material does not contain carrier granules but the toner (dry ink) particles are themselves magnetic and can therefore be transported by the magnetic roll assembly 357 without the need for carrier granules. In this mode of development toner particles are attracted directly from magnetic roll assembly 357 to the electrostatic latent image on drum 104, thus forming a toner powder image on the surface of the drum 104.

After development of the electrostatic latent image, drum 104 advances the toner powder image to transfer station D. At transfer station D, a copy substrate such as a sheet of support material is moved into contact with the toner powder image. The sheet of support material is advanced to transfer station D by a sheet feeding apparatus, indicated generally by the reference numeral 326. Preferably, sheet feeding apparatus 326 includes a feed roll 328 contacting the uppermost sheet of a stack of sheets 330. Feed roll 328 rotates in the direction of arrow 332 to advance the uppermost sheet into a nip defined by forwarding rollers 334. Forwarding rollers 334 rotate in the direction of arrow 336 to advance the sheet into chute 338. Chute 338 directs the advancing sheet into contact with photoconductive surface 312 in a timed sequence so that the toner powder image developed thereon contacts the advancing sheet at transfer station D.

Transfer station D includes a corona generating device 340, which sprays ions onto the backside of the sheet. This attracts the toner powder image from photoconductive surface 312 to the sheet. After transfer, the sheet continues to move in the direction of arrow 342 on conveyor 344 to advance to fusing station E.

Fusing station E includes a fuser assembly, indicated generally by the reference numeral 346, which permanently affixes the transferred toner powder image to the sheet. Preferably, fuser assembly 346 includes a back-up roll 348 and a heated fuser roller 350. The sheet passes between fuser roller 350 and back-up roll 348 with the powder image contacting fuser roller 350. In this manner, the toner powder image is permanently affixed to the sheet. After fusing, forwarding rollers 352 advance the sheet to catch tray 354 for subsequent removal from the reproduction machine by the operator.

After the powder image is transferred from photoconductive surface 312 to the copy sheet, drum 104 rotates the photoconductive surface to cleaning station F. At cleaning station F, a cleaning system, employing a magnetic roll assembly 357, for example, substantially identical to the magnetic roll assembly 357 of the developer unit 322, removes the residual particles adhering to photoconductive surface 312. The magnetic roll assembly 357 transports carrier granules closely adjacent to the photoconductive surface to attract residual toner particles thereto. In this way, the residual toner particles are removed from photoconductive surface 312.

Alternatively the cleaning station F may consist of a stationary elastomer cleaner blade that contacts the photoconductive surface 312. As is well known, such a cleaner-blade scrapes the toner off the surface photoconductive surface 312. The waste toner may be collected within the cleaning station F or transported out of the cleaning station F into a waste-toner container.

Figure 4:
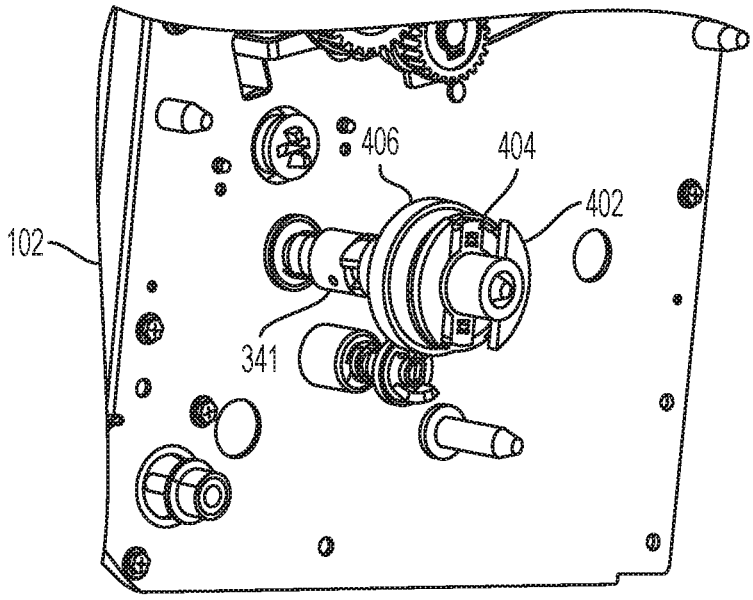
FIG. 4 is an assembly view of a print cartridge drive shaft operatively connected to a deformable electrically conductive ring according to an exemplary embodiment of this disclosure.
Figure 5:
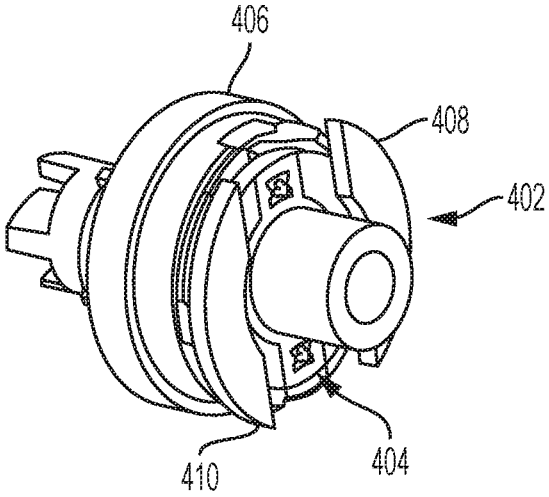
FIG. 5 is a detailed view of the electrically conductive ring shown in FIG. 4 along with a connection arrangement according to an exemplary embodiment of this disclosure.

FIG. 4 is an assembly view of a print cartridge drive shaft operatively connected to a deformable electrically conductive ring according to an exemplary embodiment of this disclosure, and FIG. 5 is a detailed view of the electrically conductive deformable ring shown in FIG. 4 along with a connection arrangement according to an exemplary embodiment of this disclosure.

Figure 6:
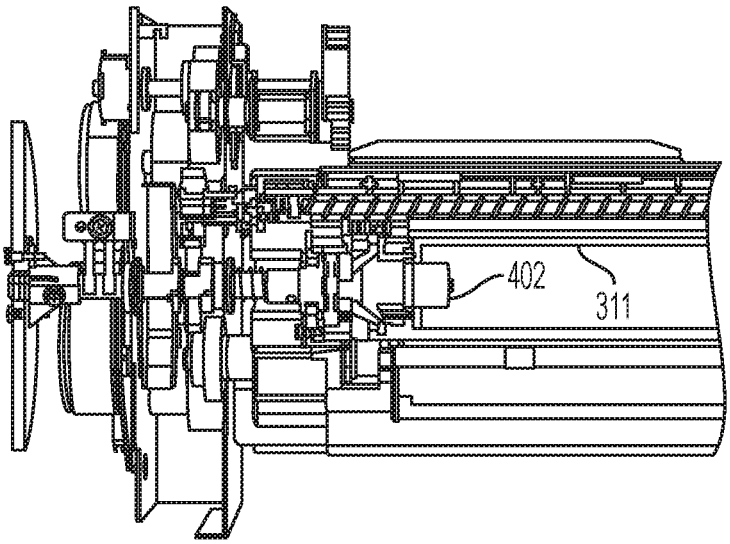
FIG. 6 is a cut-away side view of a printer cartridge including a deformable electrically conductive ring according to an exemplary embodiment of this disclosure.
Figure 7:
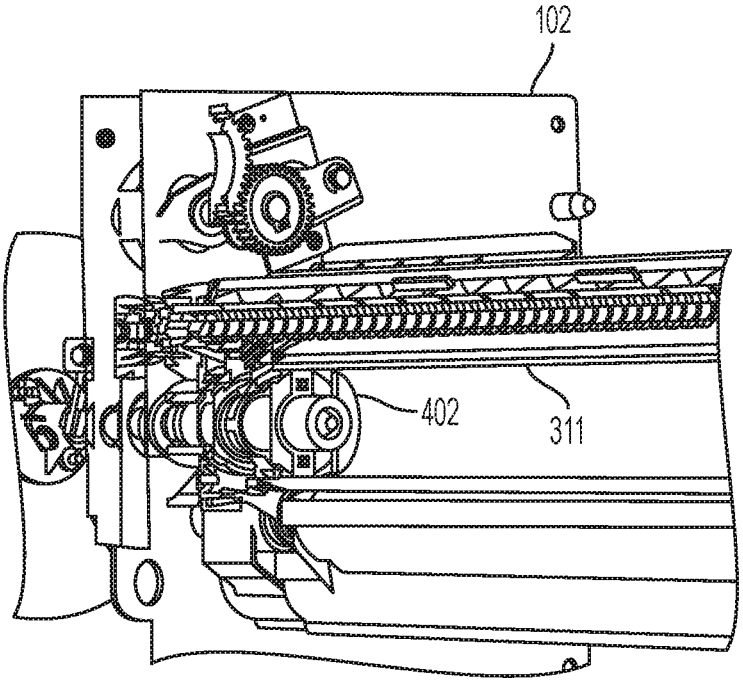
FIG. 7 is a cut-away perspective view of the printer cartridge shown in FIG. 6.

FIG. 6 is a cut-away side view of a printer cartridge including a deformable electrically conductive ring according to an exemplary embodiment of this disclosure and FIG. 7 is a cut-away perspective view of the printer cartridge shown in FIG. 6.

As shown in FIG. 4 and FIG. 5, the drive unit 102 includes a drive shaft 341 which is coupled to a photoreceptor end cap 406 which engages and rotates a photoreceptor drum 104. An electrically conductive deformable ring 402 is attached to the photoreceptor end cap using one or more metal clips 404, whereby the conductive deformable ring 402 rotates at the same rotational speed as the drive shaft 341 and engaged photoreceptor drum 104. The conductive deformable ring 402 includes conductive deformable protruding annular members 408 and 410 which physically, i.e., mechanically/electrically, contact the photoreceptor drum inside conductive substrate surface 311 to provide an electrical ground path from the photoreceptor drum 104 to the drive shaft 341.

Referring now to FIGS. 8-11, the grounding apparatus of the present disclosure, as illustrated, is further described for robustly grounding the photoreceptor assembly (PRA) 309 including a conductive photoreceptor drum 104 in a xerographic image producing machine. The grounded conductive portion is shown as a conductive drive shaft for the conductive photoreceptor drum 104 but such a grounded conductive portion can equally be any conductive element or part of the frame of the machine. As shown, the grounding apparatus according to one exemplary embodiment includes a photoreceptor drum 104, a deformable conductive ring 402, a photoreceptor end cap 406 and a drive shaft 341 operatively engaging the photoreceptor end cap 406. The photoreceptor drum 104 includes an image carrying surface 312 and an inside conductive substrate 311 which electrically conductively engages the deformable conductive ring 402 to provide electrical conduction/grounding of the photoreceptor drum 104 to the drive shaft 341.

Some non-limiting examples of deformable conductive ring material according to exemplary embodiments of this disclosure include Conductive Foam/MEC-CF Series, available from Marcom Electronic Components (UK) Ltd. and 5770 Conductive Foam available from Holland Shielding Systems BV.

In operation, the deformable conductive ring 402 engages the conductive substrate 311 of the photoreceptor drum 104 using protruding annular members 408 and 410 according to an exemplary embodiment. The protruding annular members 408 and 410 are deformable, i.e., elastic, to provide for a robust electrical conductive engagement of the photoreceptor conductive substrate 311 on the inside of the photoreceptor drum 104 with the conductive ring 402, thereby providing a robust electrical ground of the photoreceptor drum 104. The electrical conductive robustness of the conductive ring to the photoreceptor conductive substrate 311 is provided by the deformable/elastic properties of the conductive ring 402 which is made of a conductive foam or rubber material. During operation of the printing apparatus, the photoreceptor drum rotates and the deformable/elastic properties of the conductive ring 402 maintain an electrical conductive engagement of the conductive ring 402 with the inside of the photoreceptor drum 104 by providing a conformable contact to the photoreceptor drum. This conformable electrical contact arrangement increases the reliability of the electrical contact where slippage of the photoreceptor drum relative to the conductive ring may occur and/or surface irregularities associated with the conductive ring engagement members 408 and 410 and the photoreceptor conductive substrate 311 may be present.

Figure 8:
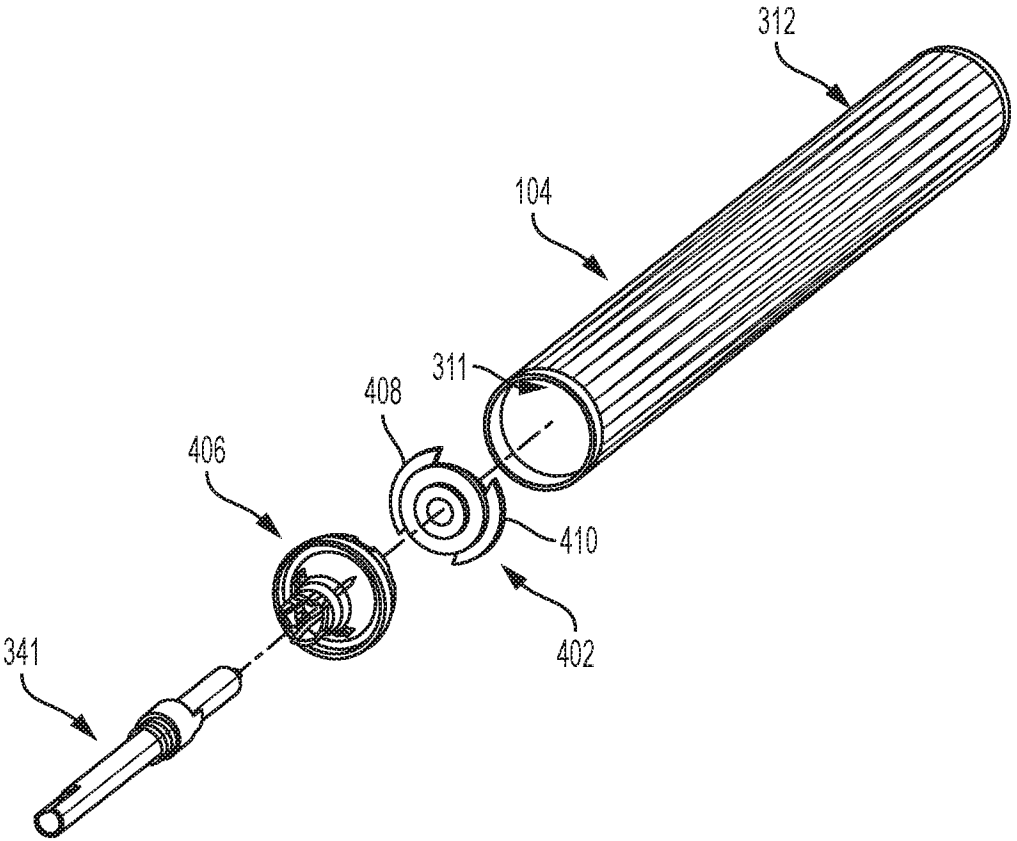
FIG. 8 is an exploded assembly view of a photoreceptor including a deformable electrically conductive ring according to an exemplary embodiment of this disclosure.
Figure 9:
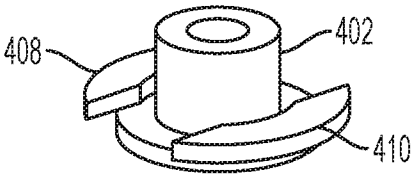
FIG. 9 is a perspective view of a drive shaft and a deformable electrically conductive ring engagement associated with a print cartridge according to an exemplary embodiment of this disclosure.
Figure 10B:
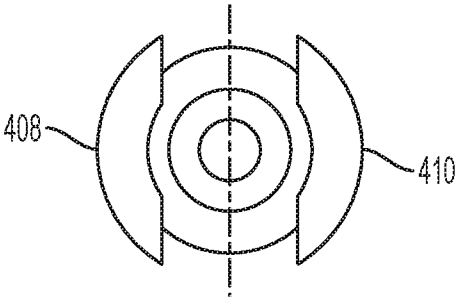
FIGS. 10A and 10B are detail views a deformable electrically conductive ring according to an exemplary embodiment of this disclosure.
Figure 10A:
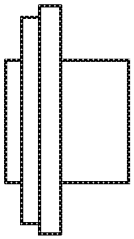

With reference to FIG. 9, illustrated is a perspective view of a deformable electrically conductive ring associated with a print cartridge as shown in FIG. 8. FIGS. 10A and 10B are detail views of the deformable electrically conductive ring shown in FIG. 8.

Figure 11:
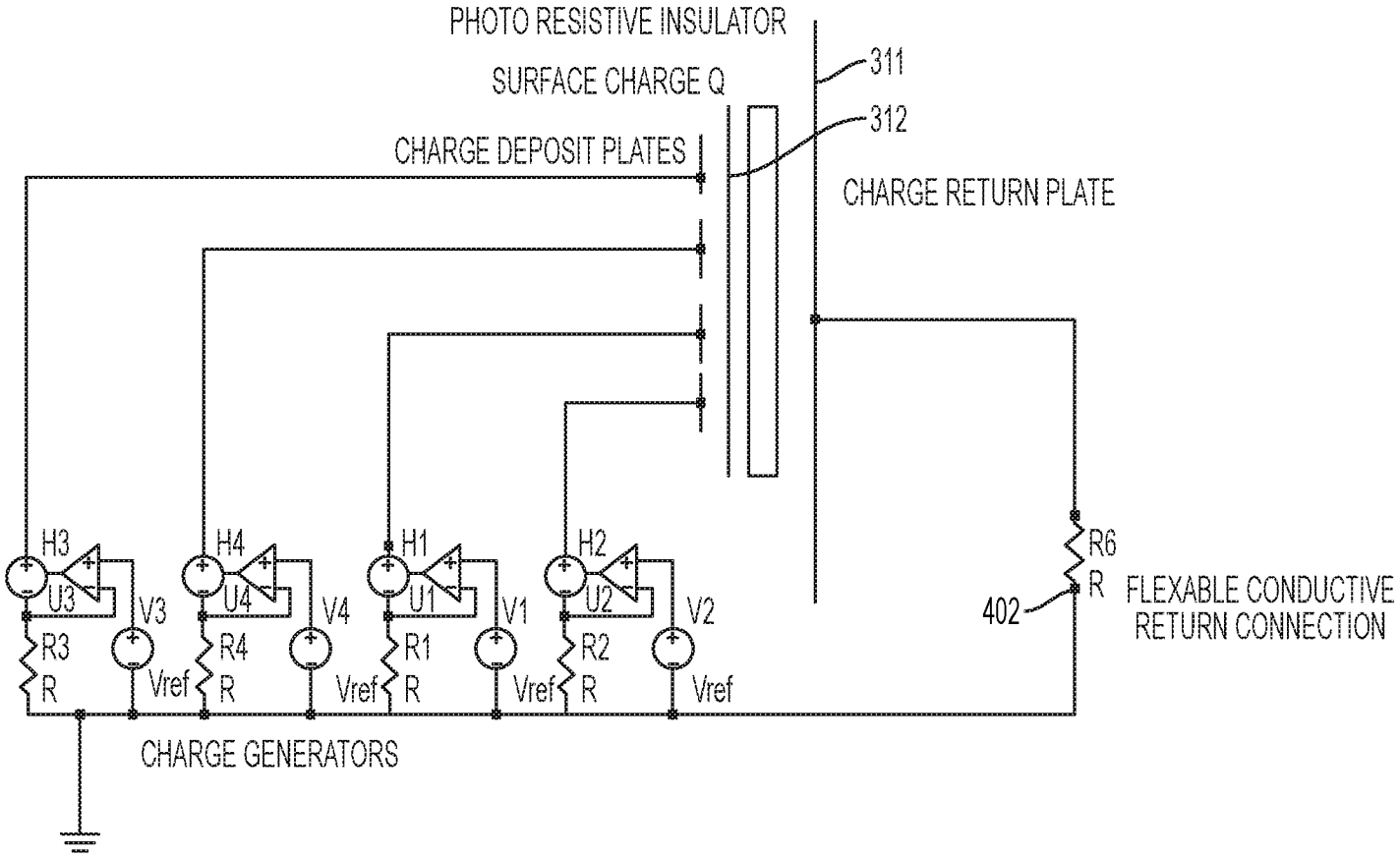
FIG. 11 is an electrical schematic of a photoreceptor charging system including a deformable electrically conductive ring and a high voltage circuit according to an exemplary embodiment of this disclosure.

With reference to FIG. 11, shown is an electrical schematic of a photoreceptor charging system including a deformable electrically conductive ring according to an exemplary embodiment of this disclosure. The photoreceptor charging system includes a plurality of high voltage charge generations H1, H2, H3 and H4 which are operatively connected to a plurality of respective charge deposit plates which alternatively transfer electrical charge to the surface of the photoreceptor image carrying surface 312.

The photoreceptor charging system is a closed loop control system for the control of surface charge on a photoresistive insulation surface. Initially, voltage generation H1, H2, H3 and H4 charge the photoresistive insulator surface. Next, a light source, i.e., laser, discharges sections of the photoresistive insulation surface to create a charge image pattern. The charge image pattern subsequently is used to attract toner particles to create a toner image as the photoreceptor drum which is then transferred to a media, such as paper or an image transfer belt.

The discharge current from the image pattern creation process passes through resistor R6, which is representative of the electrical resistance of the deformable conductive ring 402, to high voltage generator circuits H1, H2, H3 and H4. Electrical components V1, V2, V3, V4, R1, R2, R3, R4, V1 ref, V2 ref, V3 ref and V4 ref are operatively associated with monitoring the return discharge current and applying the required voltage to the charge deposit plates.

It is believed that the foregoing description is sufficient for purposes of the present disclosure to illustrate the general operation of a toner image producing machine, such as an electrostatographic reproduction machine, incorporating the features of the present disclosure therein.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A xerographic image rendering print cartridge comprising:

a drive shaft adapted to rotate at a rotational speed, the drive shaft including an electrically conductive outside surface associated with an outside diameter of the drive shaft;

a photoreceptor drum including an outside charge retentive surface and an electrically conductive inside surface proximately located at a first longitudinal end of the photoreceptor drum, the electrically conductive inside surface operatively associated with an inside diameter of the photoreceptor drum; and a deformable electrically conductive ring operatively associated with electrically connecting the photoreceptor electrically conductive inside surface to the drive shaft electrically conductive outside surface, the deformable electrically conductive ring including an electrically conductive outside surface associated with an outside diameter of the deformable electrically conductive ring and an electrically conductive inside surface associated with an inside diameter of the deformable electrically conductive ring, the outside diameter of the deformable electrically conductive ring greater than or equal to the inside diameter of the photoreceptor drum inside diameter and the inside diameter of the deformable electrically conductive ring less than or equal to the outside diameter of the drive shaft, wherein the deformable electrically conductive ring is shaped to include two or more deformable electrically conductive outside protruding annular curved surfaces separated by air gaps to provide clearance regions for the deformable electrically conductive outside protruding annular curved surfaces to expand during engagement with the photoreceptor drum electrically conductive inside surface.

2. The xerographic image rendering print cartridge according to claim 1, wherein the deformable electrically conductive ring is one of an electrically conductive foam, electrically conductive foam sheet and an electrically conductive rubber.

3. The xerographic image rendering print cartridge according to claim 1, wherein the drive shaft electrically conductive outside surface is operatively connected to an electrical ground associated with a xerographic image rendering device driving the xerographic image rendering print cartridge.

4. The xerographic image rendering print cartridge according to claim 1, wherein the print cartridge is a customer replaceable unit (CRU).

5. The xerographic image rendering print cartridge according to claim 1, wherein the deformable electrically conductive ring includes one or more of silver and graphite.

6. The xerographic image rendering print cartridge according to claim 1, further comprising:

a flanged member operatively connected to the drive shaft, the flanged member including a first outside surface associated with a diameter equal to or greater than the outside diameter of the photoreceptor drum, the flanged member including a second outside surface associated with a diameter equal to or less than the inside diameter of the photoreceptor drum, and the flanged member adapted to attach the deformable electrically conductive ring to the flanged member.

7. The xerographic image rendering print cartridge according to claim 6, further comprising:

a clip operatively associated with attaching the deformable electrically conductive ring to the flanged member.

8. A xerographic image rendering print cartridge associated with a customer replaceable unit (CRU) comprising:

including an electrically conductive outside surface associated with an outside diameter of the drive shaft;

a photoreceptor drum including an outside charge retentive surface and an electrically conductive inside surface proximately located at a first longitudinal end of the photoreceptor drum, the electrically conductive inside surface operatively associated with an inside diameter of the photoreceptor drum; and a deformable electrically conductive ring operatively associated with electrically connecting the photoreceptor electrically conductive inside surface to a drive shaft electrically conductive outside surface, the deformable electrically conductive ring including an electrically conductive outside surface associated with an outside diameter of the deformable electrically conductive ring and an electrically conductive inside surface associated with an inside diameter of the deformable electrically conductive ring, the outside diameter of the deformable electrically conductive ring greater than or equal to the inside diameter of the photoreceptor drum inside diameter and the inside diameter of the deformable electrically conductive ring less than or equal to the outside diameter of the drive shaft electrically conductive outside surface, wherein the deformable electrically conductive ring is shaped to include two or more deformable electrically conductive outside protruding annular curved surfaces separated by air gaps to provide clearance regions for the deformable electrically conductive outside protruding annular curved surfaces to expand during engagement with the photoreceptor drum electrically conductive inside surface.

9. The xerographic image rendering print cartridge according to claim 8, wherein the deformable electrically conductive ring is one of an electrically conductive foam, electrically conductive foam sheet and an electrically conductive rubber.

10. The xerographic image rendering print cartridge according to claim 8, wherein the drive shaft electrically conductive outside surface is operatively connected to an electrical ground associated with a xerographic image rendering device driving the xerographic image rendering print cartridge.

11. The xerographic image rendering print cartridge according to claim 8, wherein the deformable electrically conductive ring includes one or more of silver and graphite.

12. The xerographic image rendering print cartridge according to claim 8, further comprising:

a flanged member operatively connected to the drive shaft, the flanged member including a first outside surface associated with a diameter equal to or greater than the outside diameter of the photoreceptor drum, the flanged member including a second outside surface associated with a diameter equal to or less than the inside diameter of the photoreceptor drum, and the flanged member adapted to attach the deformable electrically conductive ring to the flanged member.

13. The xerographic image rendering print cartridge according to claim 12, further comprising:

a clip operatively associated with attaching the deformable electrically conductive ring to the flanged member.

14. A xerographic printing apparatus comprising:

a drive shaft adapted to rotate at a rotational speed, the drive shaft including an electrically conductive outside surface associated with an outside diameter of the drive shaft;

a photoreceptor drum including an outside charge retentive surface and an electrically conductive inside surface proximately located at a first longitudinal end of the photoreceptor drum, the electrically conductive inside surface operatively associated with an inside diameter of the photoreceptor drum;

a deformable electrically conductive ring operatively associated with electrically connecting the photoreceptor electrically conductive inside surface to the drive shaft electrically conductive outside surface, the deformable electrically conductive ring including an electrically conductive outside surface associated with an outside diameter of the deformable electrically conductive ring and an electrically conductive inside surface associated with an inside diameter of the deformable electrically conductive ring, the outside diameter of the deformable electrically conductive ring greater than or equal to the inside diameter of the photoreceptor drum inside diameter and the inside diameter of the deformable electrically conductive ring less than or equal to the outside diameter of the drive shaft; and a high voltage control circuit operatively connected to the photoreceptor outside charge retentive surface and operatively grounded to the electrically conductive outside surface, wherein the deformable electrically conductive ring is shaped to include two or more deformable electrically conductive outside protruding annular curved surfaces separated by air gaps to provide clearance regions for the deformable electrically conductive outside protruding annular curved surfaces to expand during engagement with the photoreceptor drum electrically conductive inside surface.

15. The xerographic printing apparatus according to claim 14, wherein the deformable electrically conductive ring is one of an electrically conductive foam, electrically conductive foam sheet and an electrically conductive rubber.

16. The xerographic printing apparatus according to claim 14, wherein the deformable electrically conductive ring includes one or more of silver and graphite.

17. The xerographic printing apparatus according to claim 14, further comprising:

a flanged member operatively connected to the drive shaft, the flanged member including a first outside surface associated with a diameter equal to or greater than the outside diameter of the photoreceptor drum, the flanged member including a second outside surface associated with a diameter equal to or less than the inside diameter of the photoreceptor drum, and the flanged member adapted to attach the deformable electrically conductive ring to the flanged member.

18. The xerographic printing apparatus according to claim 17, further comprising:

a clip operatively associated with attaching the deformable electrically conductive ring to the flanged member.

* * * * *